US007034697B2

(12) United States Patent
Oyama

(10) Patent No.: US 7,034,697 B2
(45) Date of Patent: Apr. 25, 2006

(54) AWAKENING LEVEL ESTIMATION APPARATUS FOR A VEHICLE AND METHOD THEREOF

(75) Inventor: Hajime Oyama, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 283 days.

(21) Appl. No.: 10/689,676

(22) Filed: Oct. 22, 2003

(65) Prior Publication Data

US 2004/0080422 A1 Apr. 29, 2004

(30) Foreign Application Priority Data

Oct. 23, 2002 (JP) ..... P. 2002-308086

(51) Int. Cl.
*G08B 23/00* (2006.01)

(52) U.S. Cl. ..... 340/575; 340/576; 600/554; 600/555; 600/558

(58) Field of Classification Search ..... 340/575, 340/576; 600/554, 555, 558
See application file for complete search history.

(56) References Cited

U.S. PATENT DOCUMENTS

| | | | | | |
|---|---|---|---|---|---|
| 5,786,765 | A | * | 7/1998 | Kumakura et al. | 340/576 |
| 5,798,695 | A | | 8/1998 | Metalis et al. | |
| 5,815,070 | A | | 9/1998 | Yoshikawa | |
| 6,097,295 | A | * | 8/2000 | Griesinger et al. | 340/576 |

FOREIGN PATENT DOCUMENTS

| | | |
|---|---|---|
| EP | 0 999 520 A | 5/2000 |
| EP | 1 209 019 A | 5/2002 |
| JP | 2002-087107 | 3/2002 |

* cited by examiner

*Primary Examiner*—Tai T. Nguyen
(74) *Attorney, Agent, or Firm*—McGinn & Gibb, PLLC

(57) ABSTRACT

An awakening level estimation apparatus for vehicle has: a signal processing part; a frequency component amount calculation part for calculating an average value of the frequency component powers and calculating a maximum value of the frequency component powers; a correction factor calculation part for calculating a high frequency percentile value and calculating a low frequency percentile value and calculating a correction factor; an evaluation value calculation part for calculating an evaluation value; and a decision part for deciding an awakening level of a driver.

26 Claims, 9 Drawing Sheets

AWAKENING LEVEL ESTIMATION APPARATUS FOR A VEHICLE AND METHOD THEREOF

BACKGROUND OF THE INVENTION

1. Field of the Invention

The present invention relates to an awakening level estimation apparatus and an awakening level estimation method for vehicle, and particularly to a technique for estimating an awakening level of a driver by monitoring a displacement of a vehicle in a direction of vehicle width in a time series manner.

2. Description of the Related Art

Development of a technique for preventing an accident caused by a decrease in an awakening level of a driver is one of important study problems from the viewpoint of safety, and studies on a technique for detecting a decrease in an awakening level or a warning art have been conducted actively. An awakening level estimation technique capable of accurately deciding an awakening level even in case that a large change in travel environment or vehicle speed occurs is disclosed in a JP-A-2002-154345 which is prior application of an applicant of the present application. In this estimation technique, displacement amounts of a vehicle in a direction of vehicle width is first detected in a time series manner and each frequency component power is calculated by making frequency conversion of these displacement amounts. Next, an average value of each of the frequency component powers is calculated as a high frequency component amount. Together with that, a maximum value of the frequency component powers within a predetermined frequency domain including a stagger frequency to become apparent in a state in which an awakening level of a driver decreases is calculated as a low frequency component amount. Then, an awakening level of a driver is decided based on an evaluation value corresponding to a ratio of the high frequency component amount to the low frequency component amount.

In the conventional art described above, it is decided that the awakening level of the driver is low in the case that the high frequency component amount is small and the low frequency component amount is large. However, there is a personal difference among drivers in the high frequency component amount and the low frequency component amount resulting in a criterion of awakening level estimation. As a result of that, there is a possibility that an accurate decision on the awakening level becomes difficult in the case that both of these component amounts are large (a driver with a large stagger) or the case that both of these component amounts are small (a driver with a small stagger).

SUMMARY OF THE INVENTION

The present invention is implemented in view of such circumstances, and an object of the present invention is to decide an awakening level of a driver more accurately regardless of a personal difference among drivers.

In order to solve such an object, a first invention provides an awakening level estimation apparatus for vehicle. This estimation apparatus has a signal processing part for calculating each frequency component power by making frequency conversion of a displacement amount of a vehicle in a direction of vehicle width detected in a time series manner, a frequency component amount calculation part for calculating an average value of the frequency component powers calculated by the signal processing part as a high frequency component amount and also calculating a maximum value of the frequency component powers within a predetermined frequency domain including a stagger frequency to become apparent in a state in which an awakening level of a driver decreases as a low frequency component amount, a correction factor calculation part for calculating a high frequency percentile value in which the proportion of the total sum to the sum of incidences counted from the lower frequency component powers results in a predetermined proportion in a histogram of the high frequency component amount and calculating a low frequency percentile value in which the proportion of the total sum to the sum of incidences counted from the lower frequency component powers results in a predetermined proportion in a histogram of the low frequency component amount and calculating a correction factor based on the high frequency percentile value and the low frequency percentile value, an evaluation value calculation part for calculating an evaluation value by correcting a ratio between the high frequency component amount and the low frequency component amount by the correction factor, and a decision part for deciding an awakening level of a driver based on the evaluation value.

Here, in the first invention, the predetermined proportion is preferably between about 70% and about 90%. Also, the correction factor calculation part desirably calculates a first ratio between a predetermined normal high frequency percentile value corresponding to a high frequency percentile value of a normal driver and the calculated high frequency component percentile value and calculates a second ratio between a predetermined normal low frequency percentile value corresponding to a low frequency percentile value of a normal driver and the calculated low frequency component percentile value and calculates the correction factor based on the first ratio and the second ratio. Further, the proportion of the normal low frequency percentile value to the normal high frequency percentile value is preferably between 2 times and 2.5 times.

Also, in the first invention, the evaluation value calculation part preferably calculates a ratio between the high frequency component amount and the low frequency component amount as the evaluation value in one of the case that the high frequency percentile value is larger than a predetermined upper limit value and the case that the high frequency percentile value is smaller than a predetermined lower limit value.

Also, in the first invention, the correction factor calculation part preferably calculates a correction low frequency percentile value by multiplying the low frequency percentile value by a ratio between the normal high frequency percentile value and the high frequency percentile value. In this case, the evaluation value calculation part desirably calculates a ratio between the high frequency component amount and the low frequency component amount as the evaluation value in one of the case that the correction low frequency percentile value is larger than a predetermined upper limit value and the case that the correction low frequency percentile value is smaller than a predetermined lower limit value.

Also, in the first invention, the frequency component power is preferably leveled by multiplying the frequency component power by a value multiplied by the frequency component power by a power number n of each frequency, and more specifically, the power number n is desirably a value of 2.0 or more to 3.0 or less.

Also, in the first invention, the evaluation value calculation part preferably calculates a high frequency component amount based on frequency component powers excluding a maximum value among the respective frequency component powers calculated by the frequency component amount calculation part.

Also, in the first invention, the evaluation value calculation part may calculate the evaluation value with time. In this case, the decision part preferably decides that it is in a situation in which a driver is to be warned in the case that a value of a counter is increased or decreased in response to the evaluation value and also the value of the counter reaches a determination value. Further, the decision part may vary the amount of change in the counter in response to the evaluation value.

A second invention provides an awakening level estimation method for vehicle, the method for deciding an awakening level of a driver based on an evaluation value calculated. This estimation method has a first step of calculating each frequency component power by making frequency conversion of a displacement amount of a vehicle in a direction of vehicle width detected in a time series manner, a second step of calculating an average value of the frequency component powers calculated by a signal processing part as a high frequency component amount, a third step of calculating a maximum value of the frequency component powers within a predetermined frequency domain including a stagger frequency to become apparent in a state in which the awakening level of the driver decreases as a low frequency component amount, a fourth step of calculating a high frequency percentile value in which the proportion of the total sum to the sum of incidences counted from the lower frequency component powers results in a predetermined proportion in a histogram of the high frequency component amount, a fifth step of calculating a low frequency percentile value in which the proportion of the total sum to the sum of incidences counted from the lower frequency component powers results in a predetermined proportion in a histogram of the low frequency component amount, a sixth step of calculating a correction factor based on the high frequency percentile value and the low frequency percentile value, and a seventh step of calculating an evaluation value by correcting a ratio between the high frequency component amount and the low frequency component amount by the correction factor.

Here, in the second invention, the predetermined proportion is preferably between about 70% and about 90%. Also, the sixth step may include a step of calculating a first ratio between a predetermined normal high frequency percentile value corresponding to a high frequency percentile value of a normal driver and the calculated high frequency component percentile value, a step of calculating a second ratio between a predetermined normal low frequency percentile value corresponding to a low frequency percentile value of a normal driver and the calculated low frequency component percentile value, and a step of calculating the correction factor based on the first ratio and the second ratio. In this case, the proportion of the normal low frequency percentile value to the normal high frequency percentile value is desirably between 2 times and 2.5 times.

Also, in the seventh step, a ratio between the high frequency component amount and the low frequency component amount is preferably calculated as the evaluation value in one of the case that the high frequency percentile value is larger than a predetermined upper limit value and the case that the high frequency percentile value is smaller than a predetermined lower limit value.

Also, in the sixth step, a correction low frequency percentile value may be calculated by multiplying the low frequency percentile value by a ratio between the normal high frequency percentile value and the high frequency percentile value. In this case, in the seventh step, a ratio between the high frequency component amount and the low frequency component amount is preferably calculated as the evaluation value in one of the case that the correction low frequency percentile value is larger than a predetermined upper limit value and the case that the correction low frequency percentile value is smaller than a predetermined lower limit value.

DETAILED DESCRIPTION OF THE PREFERRED EMBODIMENTS

Figure 1A:
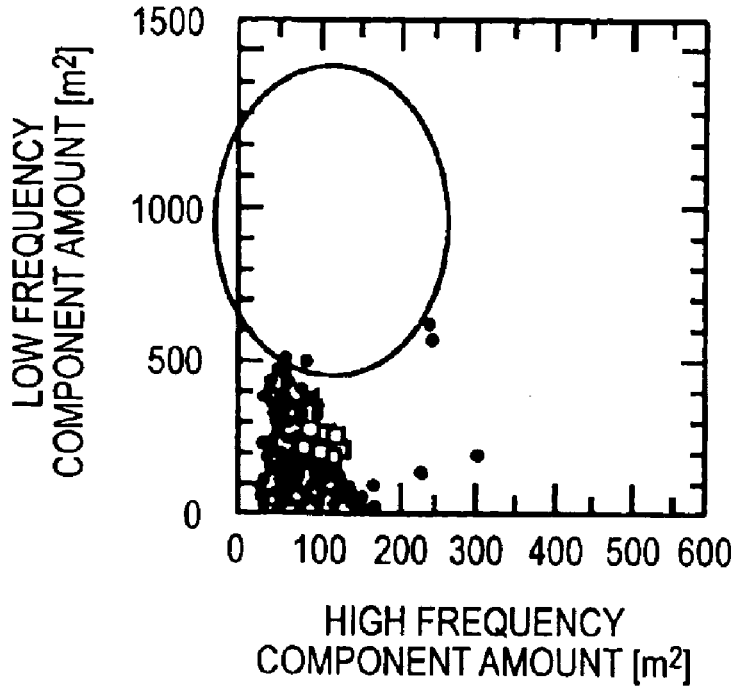
FIGS. 1A and 1B are each a distribution characteristic diagram of frequency component amounts in a situation in which a driver with a small stagger is sleepy.

An overview of an estimation technique of an awakening level according to the present embodiment will be first described with reference to FIGS. 1 and 2 prior to specific description of an awakening level estimation apparatus. FIGS. 1A and 1B are one example of a distribution characteristic diagram of frequency component amounts in a situation in which a driver with a small stagger is sleepy, and FIGS. 2A and 2B is one example of a distribution characteristic diagram of frequency component amounts in a situation in which a driver with a large stagger is not sleepy. In these diagrams, the axis of abscissa shows a high frequency component amount and the axis of ordinate shows a low frequency component amount.

Black circle points shown in the drawing plot coordinate points (frequency component amount points) represented by high frequency component amounts calculated with certain timing and low frequency component amounts calculated with the same timing as this timing. Here, the "frequency component amount" means discrete frequency component power obtained by making frequency conversion of a displacement amount of a vehicle in a direction of vehicle width detected in a time series manner. In a normal travel state, intentional steering caused by a curve etc. is performed, so that component amounts of the relatively high frequency side (high frequency component amounts) tend to stationarily appear over the whole of frequency domains regardless of an awakening state of a driver. In the embodiment, an average value of the frequency component powers calculated is used as the "high frequency component amount". On the contrary, component amounts of the relatively low frequency side (low frequency component amounts) tend to become apparent only in a travel state in which an awakening level decreases. In the embodiment, a maximum value of the frequency component powers within a predetermined frequency domain is used as the "low frequency component amount". This frequency domain, which is set with reference to a stagger frequency described below, is a low frequency band including a stagger frequency.

An area surrounded by an ellipse is an area having a great influence on awakening level estimation, that is, an area in which the high frequency component amount is small and the low frequency component amount is large. The number of frequency component amount points present within the ellipse area increases as an awakening level of a driver decreases. A value obtained by dividing the low frequency component amount by the high frequency component amount (P'slp/P'ave described below) increases as the awakening level of the driver decreases.

Figure 1B:
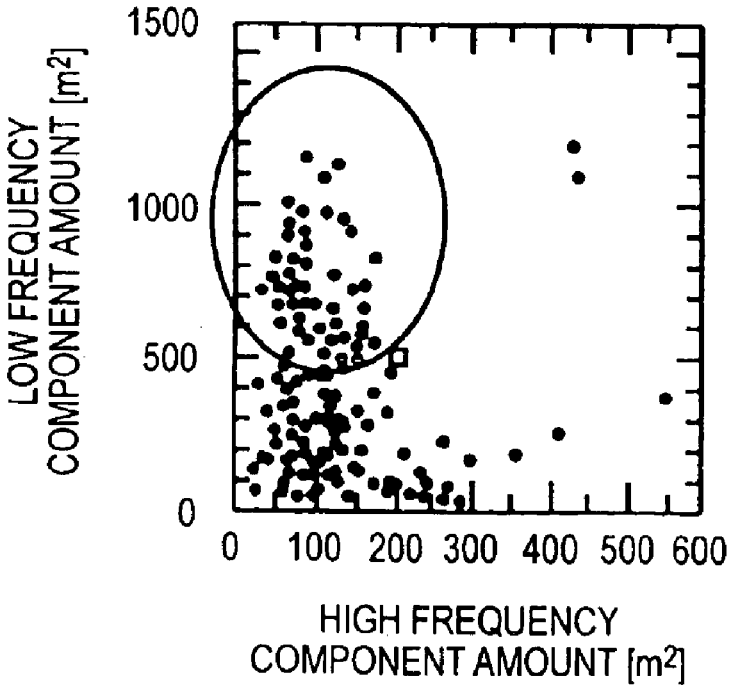

Consider an awakening state in a situation in which a driver with a small stagger is sleepy as shown in FIGS. 1A and 1B. FIG. 1A shows a distribution characteristic in which the calculated frequency component amount points (high frequency component amounts, low frequency component amounts) are plotted as they are. As a characteristic of a driver of this type, the low frequency component amount is essentially small as compared with a characteristic of a normal driver. Because of that, there are cases where the frequency component amount points do not quite appear within the area surrounded by the ellipse even under travel in which an awakening level decreases. As a result of that, there is a possibility that it is wrongly determined that the awakening level does not decrease regardless of a state in which the awakening level decreases.

Figure 2A:
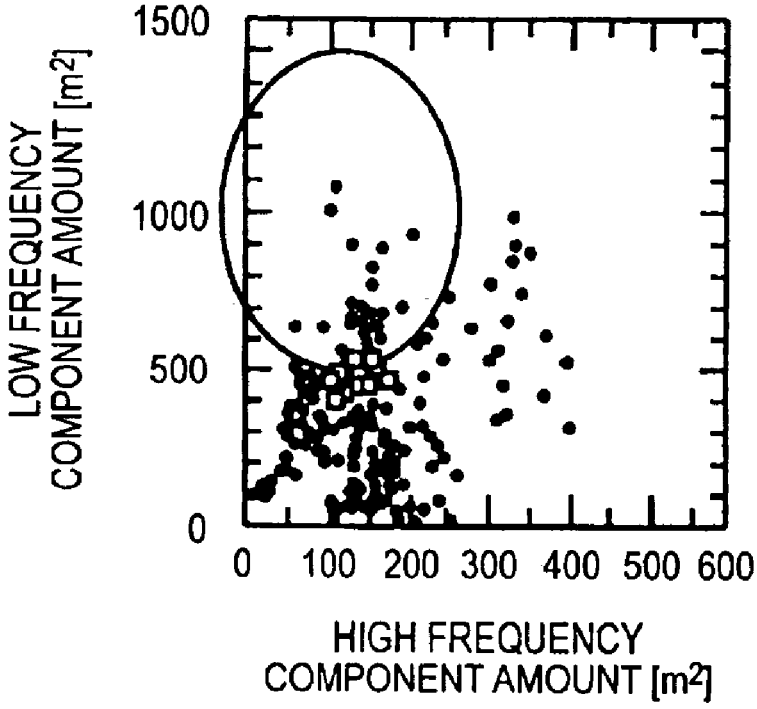
FIGS. 2A and 2B are each a distribution characteristic diagram of frequency component amounts in a situation in which a driver with a large stagger is not sleepy.
Figure 2B:
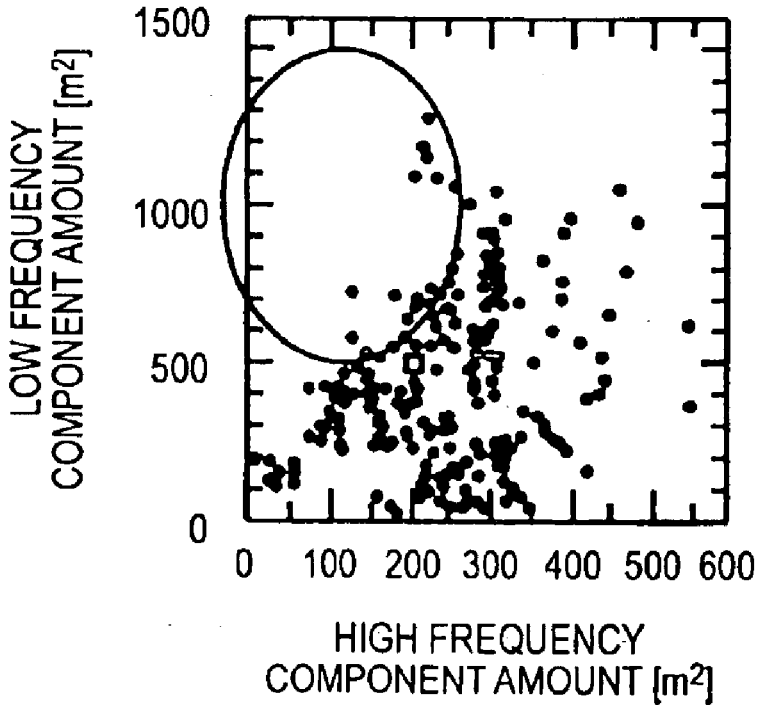

On the other hand, consider an awakening state in a situation in which a driver with a large stagger is not sleepy as shown in FIGS. 2A and 2B. FIG. 2A shows a distribution characteristic in which the calculated frequency component amount points (high frequency component amounts, low frequency component amounts) are plotted as they are. As a characteristic of a driver of this type, the low frequency component amount is essentially large as compared with a characteristic of a normal driver. Because of that, there are cases where many frequency component amount points appear within the area surrounded by the ellipse even under travel in which an awakening level does not decrease. As a result of that, there is a possibility that it is wrongly determined that the awakening level decreases regardless of a state in which the awakening level does not decrease.

A cause of occurrence of the wrong determination in the two cases described above is the point that intrinsic characteristics of individual drivers about a stagger are not taken into account. The intrinsic characteristic of the driver is reflected on a low frequency percentile value and a high frequency percentile value. White square points shown in FIGS. 1 and 2 plot coordinate points (percentile points) represented by high frequency percentile values calculated with certain timing and low frequency percentile values calculated with the same timing as this timing. There is a high correlation between percentile points (high frequency percentile values, low frequency percentile values) calculated with certain timing and frequency component amount points (high frequency component amounts, low frequency component amounts) calculated with the same timing as this timing. Here, the "high frequency percentile value" is a percentile value in which the proportion of the total sum to the sum of incidences counted from the lower frequency component powers results in a predetermined proportion in a histogram of the high frequency component amount. In one travel process performed by one driver, variations in the high frequency percentile value are relatively small and tend to become an approximately constant value (and hardly depend on an awakening state of the driver).

Incidentally, in the embodiment, the predetermined proportion is set to 80% and a 80 percentile value (80%ile value) is used, but this proportion is one example and may be within the range of between about 70% and about 90% (similar ratio applies to the next low frequency percentile value). On the other hand, the "low frequency percentile value" is a percentile value (for example, 80%ile value) in which the proportion of the total sum to the sum of incidences counted from the lower frequency component powers results in a predetermined proportion (for example, 80%) in a histogram of the low frequency component amount. This low frequency percentile value is different from the high frequency percentile value in characteristics, and variations are large and the variations tend to increase as an awakening level decreases. Incidentally, a ratio of the high frequency percentile value to the low frequency percentile value tends to become an approximately constant value as long as a driver is awake.

An inventor performed experiments on many drivers and studied travel data obtained in detail, with the result that it was proved that a percentile point (a high frequency percentile value, a low frequency percentile value) of a normal driver (a virtual driver showing the travel characteristic with the highest incidence) was (200, 400 to 500). Hereinafter, the high frequency percentile value of the normal driver is called "a normal high frequency percentile value" and is set to 200 in the embodiment. Also, the low frequency percentile value of the normal driver is called "a normal low frequency percentile value" and is set to 500 in the embodiment. Then, the percentile point of the normal driver is called "a normal percentile point". Incidentally, the proportion of the normal low frequency percentile value to the normal high frequency percentile value may be within the range of between 2 times and 2.5 times and, for example, the normal percentile point may be set to (200, 400).

In the case shown in FIG. 1A, it is found that the percentile points (high frequency percentile values, low frequency percentile values) concentrate in the vicinity of (100, 250). Therefore, in view of the fact that the percentile point of the normal driver is (200, 500), it can be decided that a driver with a characteristic shown in FIG. 1A is a driver with a small stagger essentially. On the other hand, in the case shown in FIG. 2A, it is found that the percentile points concentrate in (100 to 200, 400 to 600). Therefore, in view of the fact that the percentile point of the normal driver is (200, 500), it can be decided that a driver with a characteristic shown in FIG. 2A is a driver with a large stagger essentially.

Hence, in the embodiment, frequency component amount points are normalized by shifting the respective frequency component amount points by an aspect ratio between the percentile points and the normal percentile points calculated. For example, consider a certain frequency component amount point (100, 500) in FIG. 1A. In this case, when it is assumed that a percentile point corresponding to this frequency component amount point is (100, 250), an aspect ratio between this and a normal percentile point (200, 500) results in (width 2.0 times, length 2.0 times). As a result of that, coordinates after the shift of this frequency component amount point result in (100×2.0, 500×2.0), namely (200, 1000). By performing such a shift with respect to all the frequency component amount points, a distribution characteristic shown in FIG. 1A is corrected to a distribution characteristic shown in FIG. 1B. Through such a correction, many frequency component amount points appear within the area surrounded by the ellipse, so that a wrong determination about a driver with a small stagger essentially can be prevented effectively.

Also, a similar shift is performed with respect to a distribution characteristic shown in FIG. 2A. For example, consider a certain frequency component amount point (100, 1000) in FIG. 2A. In this case, when it is assumed that a percentile point corresponding to this frequency component amount point is (100, 500), an aspect ratio between this and a normal percentile point (200, 500) results in (width 2.0 times, length 1.0 times). As a result of that, coordinates after the shift of this frequency component amount point result in (100×2.0, 1000×1.0), namely (200, 1000). By performing such a shift with respect to all the frequency component amount points, the distribution characteristic shown in FIG. 2A is corrected to a distribution characteristic shown in FIG. 2B. Through such a correction, the number of frequency component amount points appearing within the area surrounded by the ellipse decreases, so that a wrong determination about a driver with a large stagger essentially can be prevented effectively.

In this manner, the high frequency component amount and the low frequency component amount are corrected by the aspect ratio between the percentile point and the normal percentile point calculated. Thus, all the drivers can be handled in a manner similar to a normal driver regardless of a personal difference among drivers about a stagger. As a result of that, an awakening level of the driver can be decided more accurately.

Figure 3:
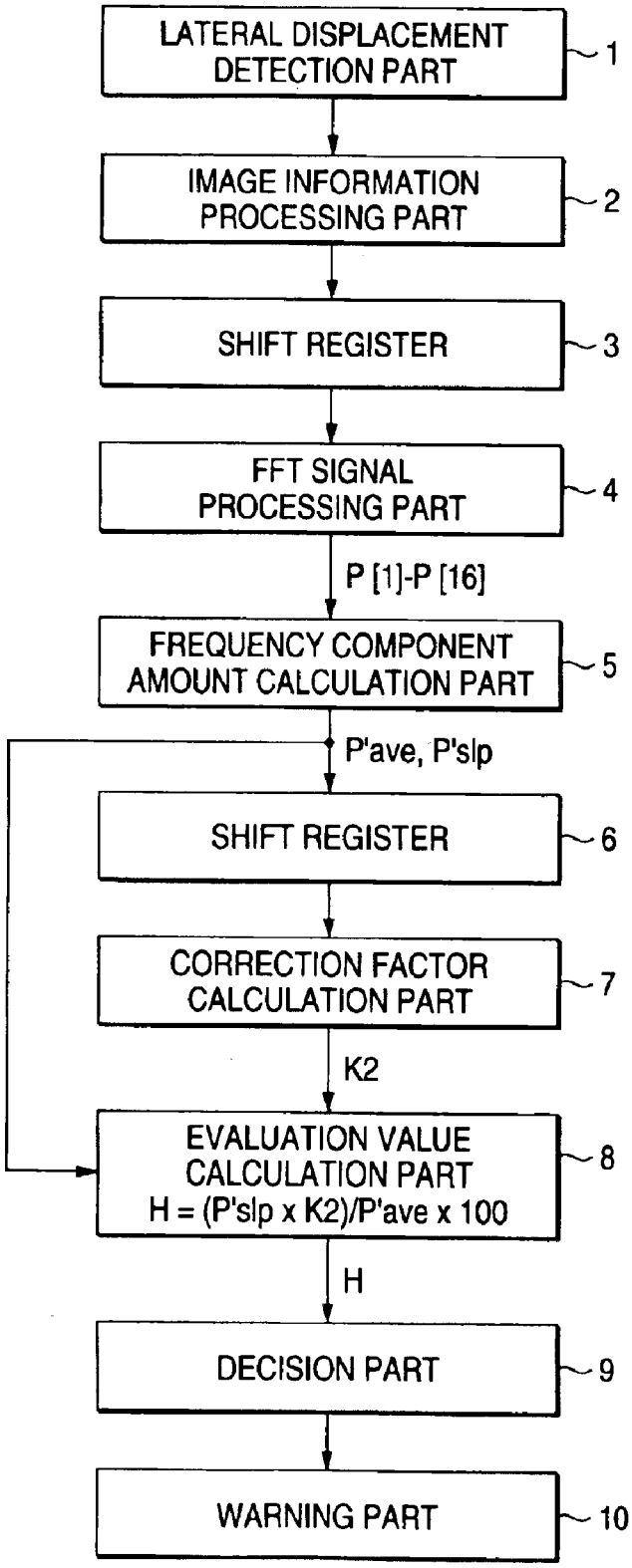
FIG. 3 is a block configuration diagram of an awakening level estimation apparatus.

Next, a vehicle awakening level estimation apparatus in the embodiment will be described with reference to FIG. 3. A lateral displacement detection part 1 detects a displacement (lateral displacement) of a vehicle in a direction of vehicle width. For example, a monocular camera or a stereo camera using a CCD (charge-coupled device) etc. can be used in this detection part 1. An image information processing part 2 processes an image obtained by the lateral displacement detection part 1 and finds a displacement amount of the vehicle. For example, images of right and left lanes of a road are picked up by the CCD and image data of one frame is stored in memory of the image information processing part 2. Then, the right and left lanes are respectively recognized using an image recognition technique. In this recognition process, an area corresponding to the lanes is identified by the image data of one frame using well-known recognition techniques such as stereo matching or a template about the lane. A vehicle position within the right and left lanes can be computed from, for example, a road width and a distance from the center of the vehicle in a lateral direction to the center of the right and left lanes.

Incidentally, the lateral displacement detection part 1 can also detect the lateral displacement by combining a vehicle speed with a GPS and navigation system or communication between road vehicles based on a magnetic coil buried in a road in addition to a self-contained detection device such as a camera (see JP-A-9-99756 with respect to a stagger warning using navigation) Further, since the lateral displacement can be estimated by a steering angle, a steering angle sensor may be used as the lateral displacement detection part 1. Also, the lateral displacement may be estimated by detecting a yaw rate or lateral acceleration. A lateral stagger (displacement amount) of the vehicle is measured, for example, with a resolution of 1 mm and a time step of 0.1 seconds. Data about the displacement amount is stored in a shift register 3 at any time. A sequence of displacement amount data calculated in a time series manner is stored by predetermined time. The data stored in the shift register 3 is sequentially updated with calculation and storage of new displacement amount data.

An FFT signal processing part 4, a frequency component amount calculation part 5, a correction factor calculation part 7, an evaluation value calculation part 8 and a decision part 9 are functional blocks implemented by a general computer mainly comprising a CPU, RAM, ROM and an input/output circuit. Under control of an application for executing a routine described below, each member constructing the computer interacts and thereby the functional blocks 4, 5, 7 to 9 are implemented. Incidentally, an awakening level estimation program, lower limit values allow, $\alpha$2'low and upper limit values $\alpha$1high, $\alpha$2'high in a correction factor calculation routine, a normal value in correction factor calculation, a lower limit value Plow of a high frequency component amount P'ave, a table for setting of a step value $\beta$ and warning determination values D1, D2, etc. are stored in the ROM.

Figure 4:
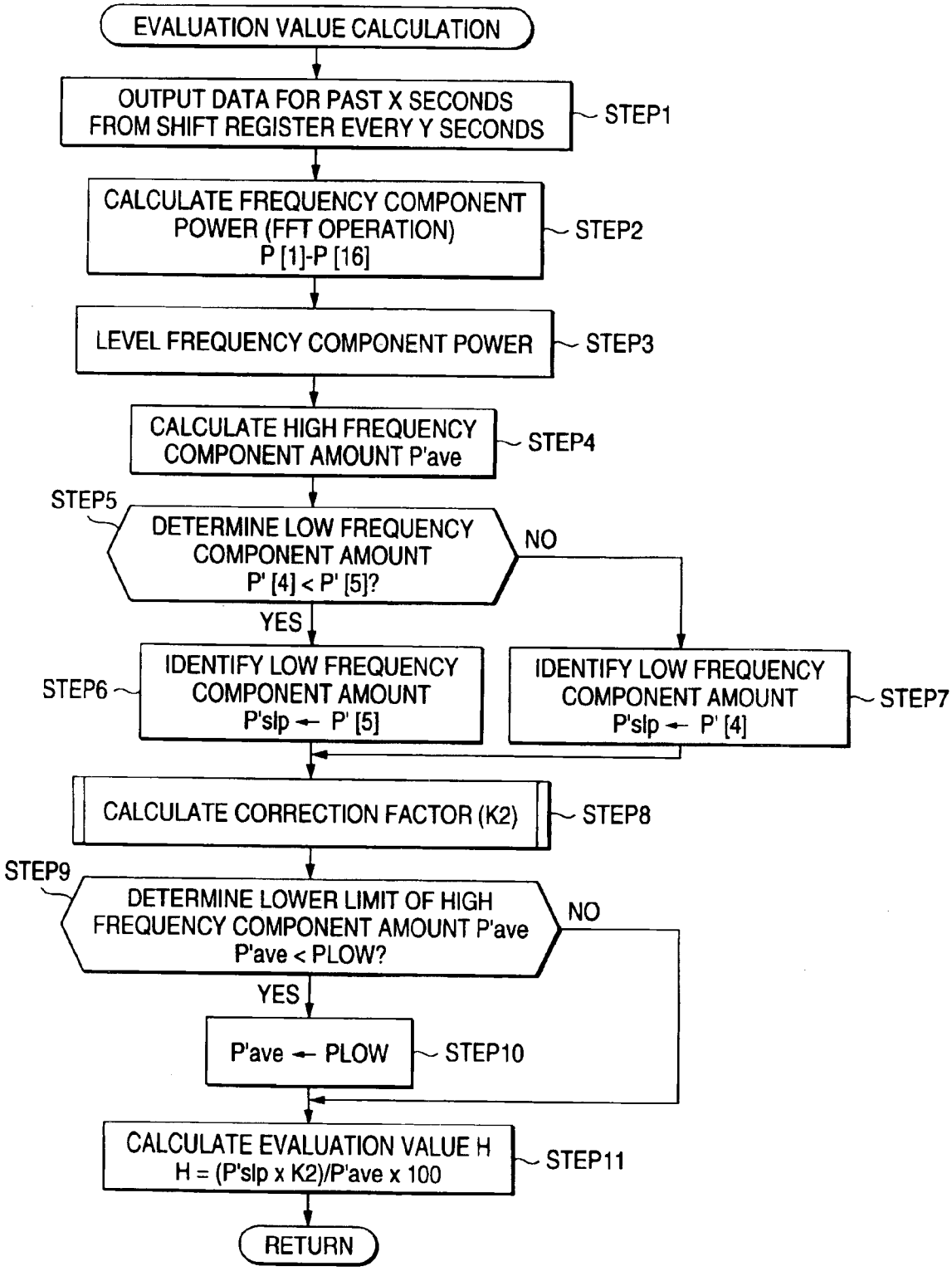
FIG. 4 is a flowchart of an evaluation value calculation routine.

FIG. 4 is a flowchart of an evaluation value calculation routine and this routine is executed repeatedly at predetermined intervals. First, in step 1, the FFT signal processing part 4 reads out displacement amount data for the past X seconds stored in the shift register 3 every Y seconds (for example, 90 seconds or shorter). In the sample time X, a long time (for example, the order of 50 to 80 seconds) is preferably set to a certain extent in order to estimate an awakening level with high accuracy.

In step 2, the FFT signal processing part 4 makes frequency conversion of displacement amounts detected in a time series manner using a fast Fourier transformation (FFT) etc. and calculates each frequency component power (amplitude) P[i] in a frequency spectrum. In the embodiment, 16 frequency component powers P[1] to P[16] are calculated in increments of 0.02 [Hz] in a frequency domain of 0.03 to 0.3 [Hz]. The reason why a frequency domain lower than 0.03 Hz is not taken into account is because the power of its domain tends to increase at the time of curve travel and directly has nothing to do with an awakening level of a driver. Also, the reason why a frequency domain higher than 0.3 Hz is not taken into account is because an operation amount necessary for calculation of an evaluation value H is decreased since the power within its frequency domain is generally small to a negligible extent.

Figure 5:
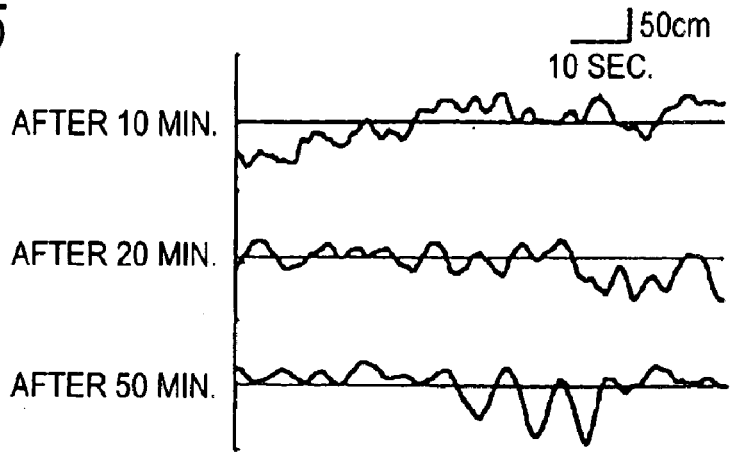
FIG. 5 is a diagram showing a change in a lateral displacement amount with time.

Here, a relation between the displacement amount and the frequency component power will be described. FIG. 5 is a diagram showing a relation between elapsed time from a driving start and a change in a lateral displacement amount. These are measured results of the cases of assuming that a relatively wide-open automotive special-purpose road is traveled in a relatively monotonous travel environment. After about 10 minutes of travel, it is in a state immediately after joining to a main road and going with a stream of traffic to travel, and the displacement amount is still small. After about 20 minutes have elapsed, it is accustomed to the travel environment and becomes a relaxing state and the displacement amount of a low frequency component increases more than the case immediately after the travel start and a high frequency component decreases. After about 50 minutes have elapsed, it becomes a state of tedious driving or having a slightly sleepy feeling and a tendency in which a large displacement amount sometimes occurs is shown. In this case, a tendency in which the displacement amount of the low frequency component increases becomes more remarkable as compared with the case of a lapse of 20 minutes.

Figure 6:
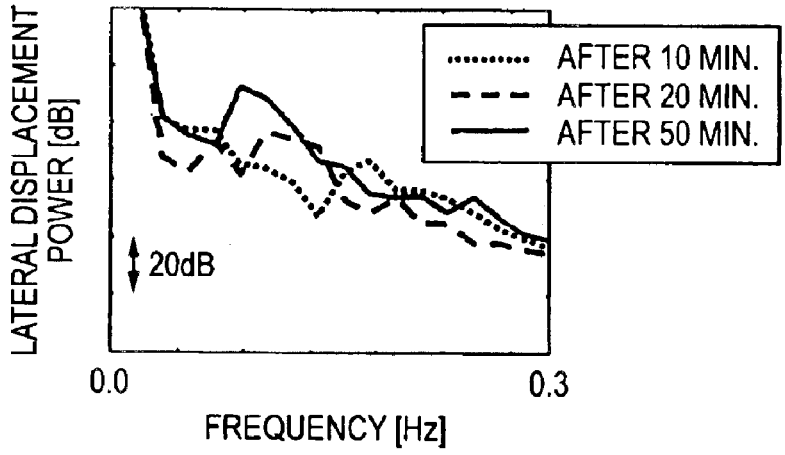
FIG. 6 is a diagram showing each frequency component power.

FIG. 6 is a diagram showing a relation between a frequency component i and its power P[i] by making frequency conversion of the displacement amount at each the elapsed time of FIG. 5 and is a diagram represented by connecting each of the discrete frequency component powers P[i] in a line graph manner. A dotted line shows each of the frequency component powers P[i] after about 10 minutes of travel and a broken line shows the powers P[i] after about 20 minutes and a solid line shows the powers P[i] after a lapse of about 50 minutes, respectively. From this diagram, it is found that there is a tendency in which the frequency component powers P[i] of a low frequency domain increase as travel time lengthens.

In step 3, the frequency component amount calculation part 5 levels each of the frequency component powers P[i] in frequency domains (i=1 to 16) of 0.03 to 0.3 [Hz] according to the following formula and calculates frequency component powers P'[i] leveled.

[Mathematical Formula 1]

$$P'[i]=P[i]\cdot f^n$$

(power number n:2.0≦n≦3.0)

In the case of considering that a stagger of a vehicle inside a lane is one of many fluctuations present in the natural world, its amplitude is 1/f and the power results in $1/f^2$. Therefore, a power number n in the mathematical formula 1 may be 2.0 theoretically, but is preferably set to n=2.5 from an experimental result. This is probably due to specifications of a vehicle, a personal difference among drivers about driving or an influence of a travel road. However, an awakening level of a driver can be decided even using an arbitrary power number in the range of 2.0 to 3.0. In the embodiment, 2.5 is used as the power number n.

Figure 7:
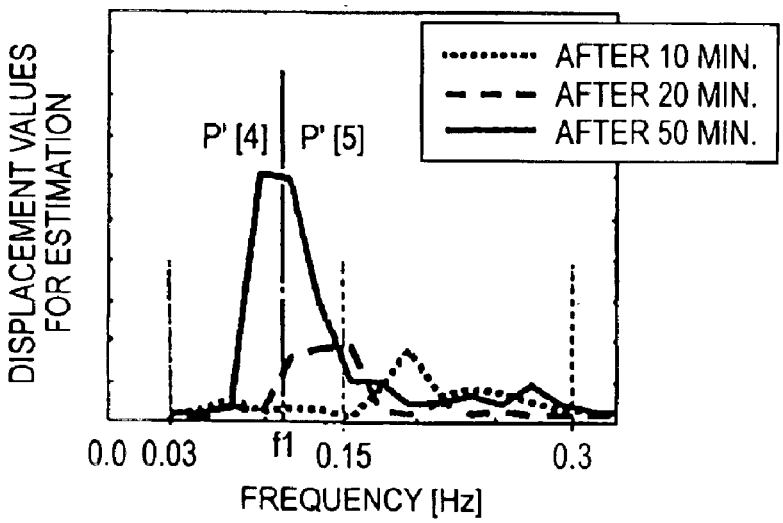
FIG. 7 is an explanatory diagram of evaluation value calculation.

FIG. 7 is a diagram showing a relation between the frequency components i and the leveled frequency component powers P'[i]. From distribution of the leveled frequency component powers P'[i], a general characteristic can be checked visually. From the same diagram, it is found that the power P'[4] of 0.09 [Hz] and the power P'[5] of 0.11 [Hz] in the vicinity of 0.1 [Hz] which is a low frequency domain, particularly a stagger frequency f1 suddenly increase after about 50 minutes. In a state in which an awakening level of a driver decreases, the power in the vicinity of the stagger frequency f1 tends to become apparent with respect to a lateral displacement of a vehicle. In other words, in the state in which the awakening level decreases, it has a feature that only the power of the low frequency domain including the stagger frequency f1 increases and a level other than the low frequency domain decreases. In view of such a tendency, the awakening level of the driver can be decided by comparing the peak of the power in the vicinity of the stagger frequency f1 with power states of frequency domains other than the stagger frequency.

Here, "the stagger frequency f1" means a frequency to become apparent (or converge) in the state in which the awakening level of the driver decreases (including a doze state). Generally, the stagger frequency tends to appear at about 0.08 to 0.12 [Hz] in a passenger vehicle, but is influenced by a response delay in vehicle behavior with steering operation, vehicle characteristics, a vehicle speed, etc. actually, so that a proper value is set every vehicle model through experiment or simulation. In the embodiment, the stagger frequency f1 is set to 0.01 [Hz].

In step 4 subsequent to step 3, the frequency component amount calculation part 5 obtains the total sum of each of the frequency component powers P'[1] to P'[16] and calculates its average value as a high frequency component amount P'ave. However, in the embodiment, in order to reflect the awakening level of the driver on the evaluation value H more accurately, the maximum power among each of the frequency component powers P'[1] to P'[16] is excluded and the high frequency component amount P'ave is calculated from the remaining frequency component powers P'[i]. The reason why such filtering is performed is because an influence of an increase in power of the stagger frequency f1 and an influence of disturbance are eliminated.

In step 5, the frequency component amount calculation part 5 makes a determination of stagger frequency power, that is, compares sizes of the frequency component powers P'[4] and P'[5] in a predetermined frequency domain (0.09 to 0.11 [Hz]) including the stagger frequency f1 (0.1 [Hz]). Then, the larger frequency component power is set as a low frequency component amount P'slp. That is, when the power P'[5] of 0.11 [Hz] is larger than the power P'[4] of 0.09 [Hz], the power P'[5] is set as the low frequency component amount P'slp (step 6). On the other hand, when the power P'[4] of 0.09 [Hz] is larger than or equal to the power P'[5] of 0.11 [Hz], the power P'[4] is set as the low frequency component amount P'slp (step 7). Then, a set of the high frequency component amount P'ave and the low frequency component amount P'slp calculated in steps 4 to 7 is stored in a shift register 6.

Figure 8:
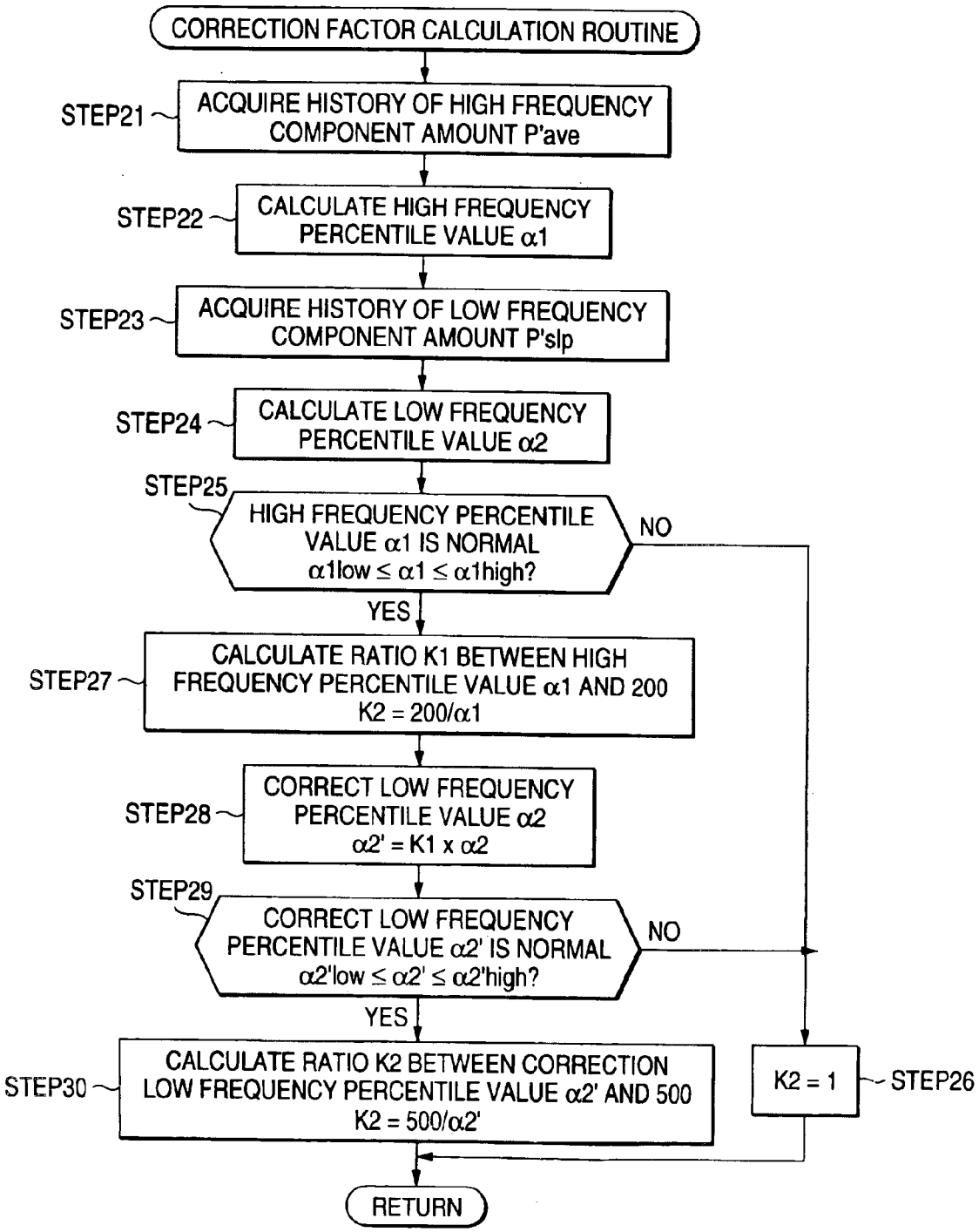
FIG. 8 is a flowchart of a correction factor calculation routine.

In step 8, the correction factor calculation part 7 calculates a correction factor K2 based on the high frequency component amount P'ave and the low frequency component amount P'slp. FIG. 8 is a flowchart of a correction factor calculation routine and this routine is executed repeatedly at predetermined intervals. First, in step 21, the correction factor calculation part 7 acquires a history of the high frequency component amount P'ave stored in the shift register 6. In the embodiment, the number of histories of the high frequency component amount P'ave acquired is set to 500 samples as one example.

Figure 9:
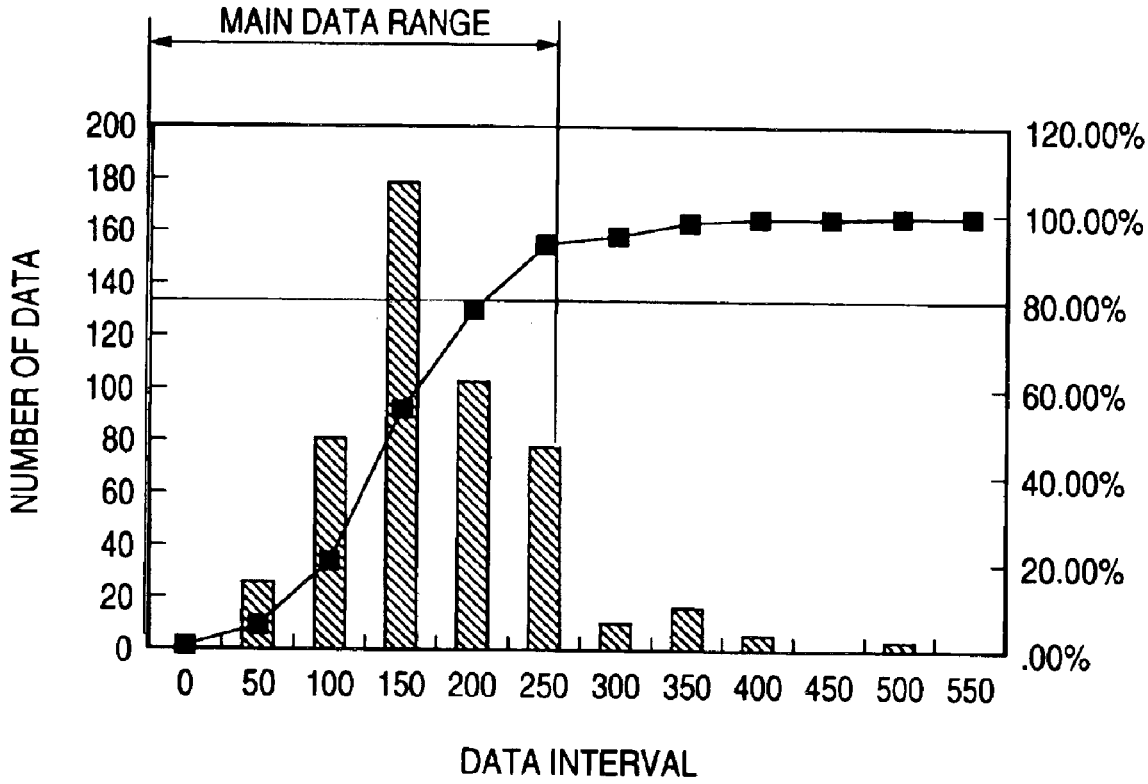
FIG. 9 is an explanatory diagram of a high frequency percentile value.

In step 22, the correction factor calculation part 7 calculates a high frequency percentile value α1 based on the high frequency component amount P'ave. FIG. 9 is an explanatory diagram of the high frequency percentile value α1. First, the correction factor calculation part 7 creates a histogram of the high frequency component amount P'ave by the samples acquired. Next, in this histogram, a value in which the proportion of the total sum to the sum of incidences counted from the lower frequency component powers results in a predetermined proportion is set to the high frequency percentile value α1. In the embodiment, this proportion is set to 80% and a 80 percentile value of the high frequency component amount P'ave is calculated. In other words, the value α1 calculated thus is a threshold value of 80% from the lower frequency component powers. By this threshold value, an abnormal value in the histogram is eliminated and a main data range in this histogram can be approximated to normal distribution.

In step 23, the correction factor calculation part 7 acquires a history of the low frequency component amount P'slp stored in the shift register 6. In the embodiment, the number of histories of the low frequency component amount P'slp acquired is set to 500 samples as one example.

In step 24, the correction factor calculation part 7 calculates a low frequency percentile value α2 based on the low frequency component amount P'slp. First, the correction factor calculation part 7 creates a histogram of the low frequency component amount P'slp by the samples acquired. Next, in this histogram, it is counted from the lower frequency component powers and a 80 percentile value of the low frequency component amount P'slp is set to the low frequency percentile value α2.

In step 25, the correction factor calculation part 7 decides whether or not the high frequency percentile value α1 is normal. That is, it decides whether or not this value α1 is larger than a predetermined lower limit value α1low (for example, 100) or this value α1 is larger than a predetermined upper limit value α1high (for example, 300). When the high frequency percentile value α1 is within the range from the lower limit value α1low to the upper limit value α1high, the flowchart proceeds to step 27. On the contrary, when the high frequency percentile value α1 is smaller than the lower limit value α1low or is larger than the upper limit value α1high, it is decided that the high frequency percentile value α1 is not normal, and the flowchart proceeds to step 26. The reason why such a threshold value is provided is because when the high frequency percentile value α1 is not within the range of these values, an influence of a factor (for example, an influence of an environmental factor) other than a personal difference among drivers is large and it is improper as data corrected to a normal driver. That is, in the case that the high frequency percentile value α1 is smaller than the lower limit value α1low, when a correction is made to such a driver, there is a high possibility of wrongly determining that an awakening level decreases. Also, in the case that the high frequency percentile value α1 is larger than the upper limit value α1high, there is a high possibility that a stagger of a vehicle occurs in a state in which the stagger is not recognized accurately or at the time of starting to enter a freeway.

In step 26, 1 is set as the correction factor K2. This means that in step 11 of calculating the evaluation value H described below, without correcting a value of P'slp/P'ave, this value is set to the evaluation value H as it is.

On the other hand, in step 27, the correction factor calculation part 7 calculates K1 which is a ratio between the high frequency percentile value α1 and a predetermined normal high frequency percentile value. This normal high frequency percentile value is a value corresponding to the high frequency percentile value α1 of a normal driver and is set to 200 in the embodiment. Next, in step 28, the correction factor calculation part 7 calculates a correction low frequency percentile value α2' by multiplying the low frequency percentile value α2 by the ratio K1 calculated in step 27.

In step 29, the correction factor calculation part 7 decides whether or not the correction low frequency percentile value α2' is normal. That is, it decides whether or not this value α2' is larger than a predetermined lower limit value α2'low (for example, 400) or this value α2' is larger than a predetermined upper limit value α2'high (for example, 500). When the correction low frequency percentile value α2' is within the range from the lower limit value α2'low to the upper limit value α2'high, the flowchart proceeds to step 30. On the contrary, when the correction low frequency percentile value α2' is smaller than the lower limit value α2'low or is larger than the upper limit value α2'high, it is decided that the correction low frequency percentile value α2' is not normal, and the flowchart proceeds to step 26. The reason why such a threshold value is provided is because when the correction low frequency percentile value α2' is not within the range of these values, an influence of a factor other than a personal difference among drivers is large and it is improper as data corrected to a normal driver. That is, in the case that the correction low frequency percentile value α2' is smaller than the lower limit value α2'low, when a correction is made to such a driver, there is a high possibility of wrongly determining that an awakening level decreases. Also, in the case that the correction low frequency percentile value α2' is larger than the upper limit value α2'high, it is in a state in which a decrease in an awakening level of a driver continues.

In step 26, 1 is set as the correction factor K2. This means that in step 11 of calculating the evaluation value H described below, without correcting a value of P'slp/P'ave, this value is set to the evaluation value H as it is in a manner similar to the case of step 26.

In step 30, the correction factor calculation part 7 calculates the correction factor K2 based on the correction low frequency percentile value α2'. This correction factor K2 is calculated as a ratio between the corrected low frequency percentile value α2' and a predetermined normal low frequency percentile value. This normal low frequency percentile value is a value corresponding to the low frequency percentile value α2 of a normal driver and is set to 500 in the embodiment.

Incidentally, the correction factor K2 calculated thus is calculated by steps 25 to 30 in order to decide whether or not the high frequency percentile value α1 and the correction low frequency percentile value α2' are normal. However, in the case of only calculating its value, the value may be calculated by the following procedure. First, a first ratio which is a ratio between a normal high frequency percentile value and the high frequency percentile value α1 is calculated. Next, a second ratio which is a ratio between a normal low frequency percentile value and the low frequency percentile value α2 is calculated. Then, the correction factor K2 can be calculated by totaling the first ratio and the second ratio calculated thus.

In step 9, the evaluation value calculation part 8 determines a lower limit of the high frequency component amount P'ave, that is, decides whether or not the high frequency component amount P'ave is smaller than a preset lower limit value Plow (for example, 100). When the high frequency component amount P'ave is smaller than the lower limit value Plow, it is decided that an awakening state of a driver is stable, and the high frequency component amount P'ave is set to the lower limit value Plow (step 10). As a result of this, in the case of calculation of the evaluation value H in step 11, a situation in which a denominator becomes too small and the evaluation value H becomes large improperly is prevented (an increase in the evaluation value H means a decrease in the awakening level). On the contrary, when the high frequency component amount P'ave is larger than or equal to the lower limit value Plow, step 10 is skipped and the flowchart proceeds to step 11.

In step 11, the evaluation value calculation part 8 calculates the evaluation value H based on the following formula. This evaluation value H corresponds to an instantaneous awakening level without consideration of a factor with time, and is calculated by correcting a ratio between the high frequency component amount P'ave and the low frequency component amount P'slp by the correction factor K2. Incidentally, as described above, in the case of determining that the high frequency percentile value α1 and the correction low frequency percentile value α2' are abnormal, 1 is set to the correction factor K2 in step 26. The evaluation value H calculated in this case corresponds to an evaluation value H calculated without being corrected by the correction factor K2. Then, after the evaluation value H is calculated in step 11, the present routine exits.

[Mathematical Formula 2]

$$H=(P'slp\times K2)/P'ave\times 100$$

As shown in FIG. 7, in a state in which a driver is awake (after a lapse of about 10 minutes), the low frequency component amount P'slp (P'[4]) or P'[5]) is small, so that the evaluation value H becomes a small value. On the contrary, in a state in which an awakening level of a driver decreases (after a lapse of about 50 minutes), the low frequency component amount P'slp increases, so that a value of the evaluation value H becomes large. Thus, the evaluation value H results in a value reflecting the awakening level of the driver.

Figure 10:
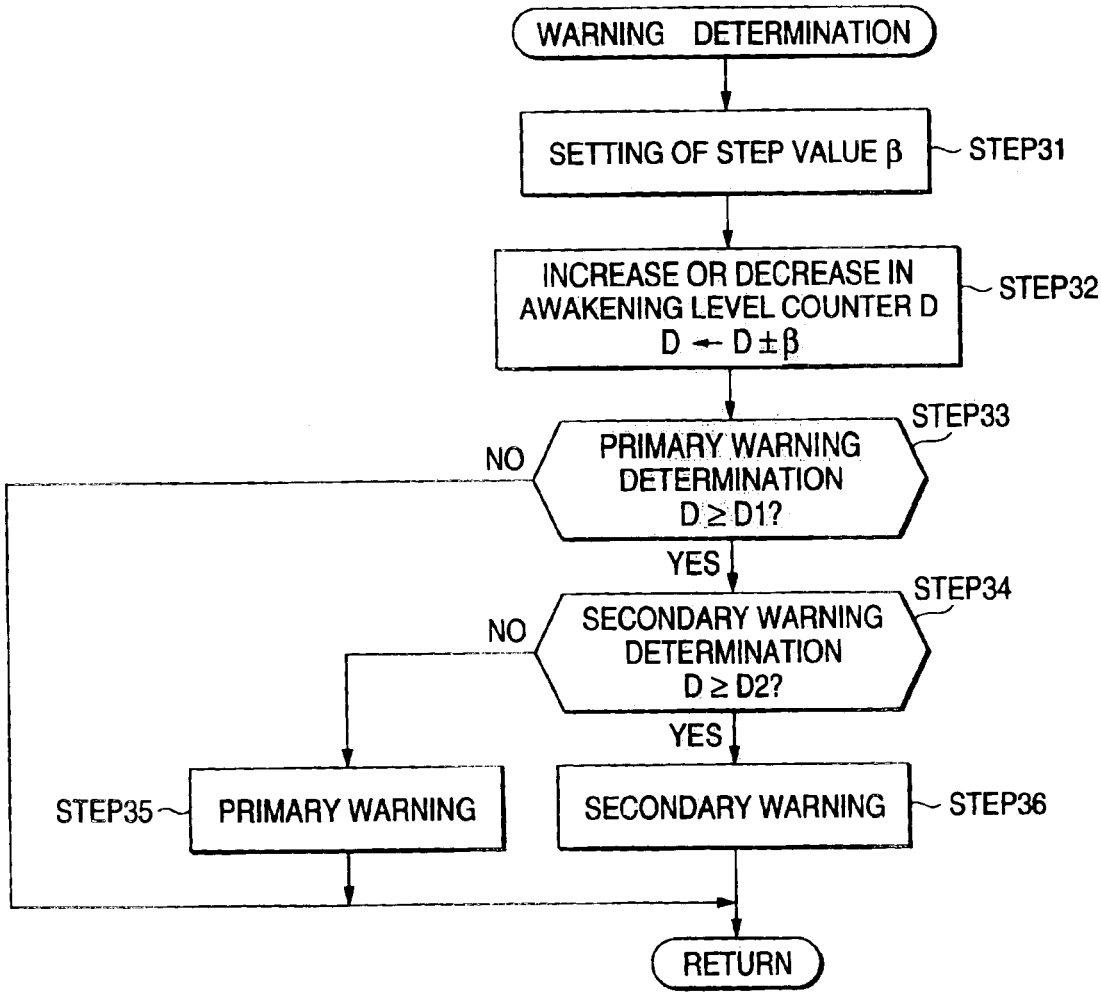
FIG. 10 is a flowchart of a warning determination routine.

FIG. 10 is a flowchart of a warning determination routine and this routine is executed repeatedly at predetermined intervals. First, in step 31, the decision part 9 sets constants β1 to β8, 0 as step values β from the following table based on the evaluation value H calculated in an evaluation value calculation routine which is another routine. Incidentally, these constants have a non-linear relation equipped with |β1|>|β2|>|β3|>|β4|>|β5|, |β6|<|β7|<|β8| since the amount of change in an awakening level counter D is varied in response to a value of the evaluation value H.

(Setting of Step Values)

| Evaluation value H | Step value β |
|---|---|
| >1000 | +β1 |
| >900 | +β2 |
| >800 | +β3 |
| >500 | +β4 |
| >400 | +β5 |
| >300 | ±0 |
| >200 | −β6 |
| >100 | −β7 |
| >0 | −β8 |

Next, in step 32, the decision part 9 updates a value of the awakening level counter D by adding the step value β to the current value of the awakening level counter D or subtracting the step value β from the current value. Then, in step 33, a primary warning determination is made, that is, it is decided whether or not the awakening level counter D is larger than or equal to a first determination value D1. If not in this step 33, it is decided that a driver is in an awakening state, and the present routine exits. On the other hand, when the awakening level counter D is larger than or equal to the first determination value D1, it is decided that there is a need to urge an awakening on the driver, and the flowchart proceeds to step 34.

In step 34, a secondary warning determination is made, that is, it is decided whether or not the awakening level counter D is larger than or equal to a second determination value D2. If not in this step 34, in order to give a warning of a stagger of a vehicle due to a decrease in an awakening level of a driver, the present routine exits after giving a primary warning to a warning part 10 (step 35). On the other hand, if so in step 34, in order to give a warning of a doze state in which the awakening level of the driver decreases further, the present routine exits after giving secondary warning processing to the warning part 10 (step 36).

The warning part 10 receives instructions from the decision part 9 and performs various warning processing for urging an awakening on the driver. As the warning processing, various cases are considered and as one example, a case of sounding a collision warning is given. That is, when it is decided that the awakening level decreases, a warning distance between vehicles is set to a longish distance than usual (early timing). Also, the warning part 10 may sound a deviation warning. For example, timing constructed so as to sound at the instant of treading on a lane is early set at the time of a decrease in the awakening level. Further, a doze warning may be sounded. For example, at the time of a decrease in the awakening level, "stagger caution" is displayed on a display screen along with a stagger warning beep.

Figure 11:
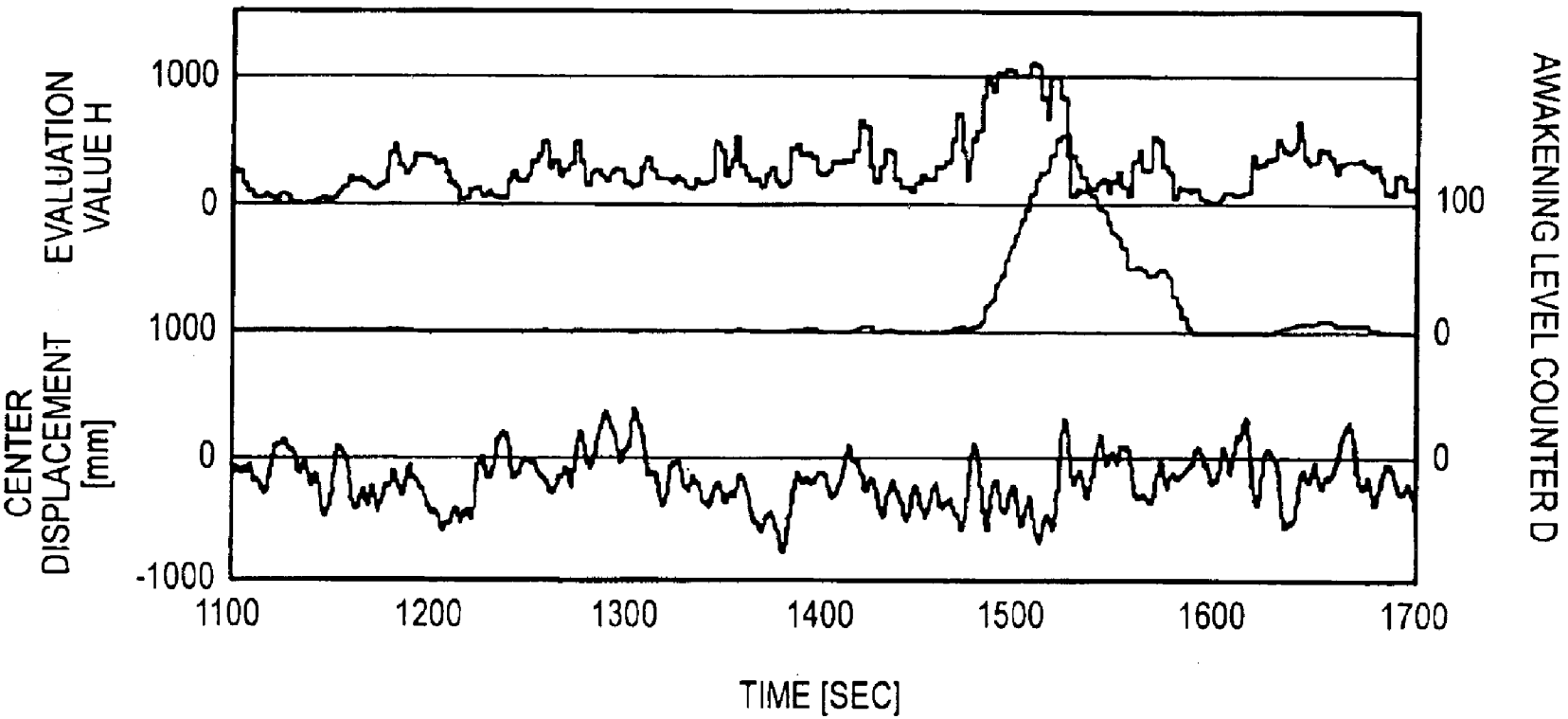
FIG. 11 is a diagram showing an actual measured result at the time of freeway travel.

FIG. 11 is a diagram showing an actual measured result at the time of freeway travel, and the lower portion shows a characteristic of a lateral displacement of a vehicle and the upper portion shows a characteristic of the evaluation value H and the middle portion shows a characteristic of the awakening level counter D, respectively. In the vicinity of a lapse of 1400 seconds since a travel start, the characteristic peaks continuously appear in the lateral displacement of the vehicle and the stagger frequency f1 of 0.1 [Hz] becomes apparent. As a result of this, the evaluation value H increases and a value of the awakening level counter D is incremented, so that a warning to a driver is given properly. Incidentally, depending on a measurement situation, the peak of the evaluation value H singly appears even before a lapse of 1400 seconds. However, in the embodiment, the warning to the driver is not given unless such peaks continuously appear (in other words, unless the awakening level counter D is continuously incremented).

Thus, in the embodiment, varying sizes of a value of the high frequency component amount P'ave and a value of the low frequency component amount P'slp caused by a personal difference among drivers can be solved by correcting the evaluation value H by the correction factor K2. Therefore, various drivers as shown in FIGS. 1 and 2 can be handled as a normal driver, so that a problem of a wrong determination caused by the personal difference among drivers can be solved and an awakening level of the driver can be decided more accurately.

Also, in the embodiment, in the case of deciding that the high frequency percentile value α1 and the correction low frequency percentile value α2' are not normal, a correction by the correction factor K2 is not made (corresponding to K2=1) and the evaluation value H is calculated. Since the evaluation value H is calculated thus, when influences of an environmental factor etc. are large, a problem that these influences are also corrected and the evaluation value H is calculated can be solved.

Also, in the embodiment, an awakening level of a driver is decided by comparing the peak of the power in the vicinity of the stagger frequency f1 with the powers of frequency domains other than the stagger frequency. Therefore, there is no need to previously prepare samples at the time of normal driving and based on only data (including the just previous data) at the time of determination, the awakening level of the driver can be decided. As a result of that, without depending on a change in travel environment, the awakening level can be determined properly and a problem of a wrong determination caused by the change in travel environment as described in the conventional art can be solved.

Also, the evaluation value H is calculated after a lower limit value is set with respect to a level of the high frequency component amount P'ave described above. As a result of this, a situation in which a denominator in the mathematical formula 2 used as a calculation formula of the evaluation value H becomes too small by P'ave is prevented, so that the awakening level can be estimated accurately without being influenced by a driving pattern specific to a driver or slight disturbance at the time of high-speed travel.

Also, in the embodiment, when the peak of the power within a frequency domain including the stagger frequency f1 becomes more apparent than that of the powers of frequency domains other than the stagger frequency due to a stagger of the lateral displacement of the vehicle, a decrease in the awakening level of the driver is detected. In such a detection technique, even when a situation in which a lateral displacement amount is generally small or a slight side wind or a situation of passing by a large-size vehicle occurs at the time of stable high-speed travel, a wrong determination of the awakening level can be prevented.

Further, conventionally, by performing time averaging of a single awakening level and calculating the final awakening level and comparing its value with a threshold value for warning determination, it has been decided whether or not to give a warning. However, in such a conventional technique, there is a problem that a time delay in the warning occurs. On the contrary, in a counter method as described in the embodiment, the step value β of the awakening level counter D is increased in the case that the evaluation value H corresponding to a single awakening level is large (particularly, the case that an awakening state decreases remarkably). Therefore, a warning can be given without delay as compared with time averaging processing used as a linear counter.

In the present invention thus, various drivers can be handled as a normal driver by correcting an evaluation value by a correction factor. As a result of this, a wrong determination caused by a personal difference among drivers can be solved and an awakening level of a driver can be decided more accurately.

The disclosure of Japanese Patent Application No. 2002-308086 filed on Oct. 23, 2002 including the specification, drawings and abstract is incorporated herein by reference in its entirety.

While the presently preferred embodiments of the present invention have been shown and described, it is to be understood that these disclosures are for the purpose of illustration and that various changes and modifications may be made without departing from the scope of the present invention as set forth in the appended claims.

What is claimed is:

1. An awakening level estimation apparatus for vehicle comprising:

a signal processing part for calculating each frequency component power by making frequency conversion of a displacement amount of a vehicle in a direction of vehicle width detected in a time series manner;

a frequency component amount calculation part for calculating an average value of the frequency component powers calculated by the signal processing part as a high frequency component amount and also calculating a maximum value of the frequency component powers within a predetermined frequency domain including a stagger frequency to become apparent in a state in which an awakening level of a driver decreases as a low frequency component amount;

a correction factor calculation part for calculating a high frequency percentile value in which the proportion of the total sum to the sum of incidences counted from the lower frequency component powers results in a predetermined proportion in a histogram of the high frequency component amount and calculating a low frequency percentile value in which the proportion of the total sum to the sum of incidences counted from the lower frequency component powers results in a predetermined proportion in a histogram of the low frequency component amount and calculating a correction factor based on the high frequency percentile value and the low frequency percentile value;

an evaluation value calculation part for calculating an evaluation value by correcting a ratio between the high frequency component amount and the low frequency component amount by the correction factor; and a decision part for deciding an awakening level of a driver based on the evaluation value.

2. The awakening level estimation apparatus for vehicle as defined in claim 1, wherein the predetermined proportion is between about 70% and about 90%.

3. The awakening level estimation apparatus for vehicle as defined in claim 2, wherein the correction factor calculation part calculates a first ratio between a predetermined normal high frequency percentile value corresponding to a high frequency percentile value of a normal driver and the calculated high frequency component percentile value and calculates a second ratio between a predetermined normal low frequency percentile value corresponding to a low frequency percentile value of a normal driver and the calculated low frequency component percentile value and calculates the correction factor based on the first ratio and the second ratio.

4. The awakening level estimation apparatus for vehicle as defined in claim 3, wherein the proportion of the normal low frequency percentile value to the normal high frequency percentile value is between 2 times and 2.5 times.

5. The awakening level estimation apparatus for vehicle as in claim 4, wherein the evaluation value calculation part calculates a ratio between the high frequency component amount and the low frequency component amount as the evaluation value in one of the case that the high frequency percentile value is larger than a predetermined upper limit value and the case that the high frequency percentile value is smaller than a predetermined lower limit value.

6. The awakening level estimation apparatus for vehicle as in claim 5, wherein the correction factor calculation part calculates a correction low frequency percentile value by multiplying the low frequency percentile value by a ratio between the normal high frequency percentile value and the high frequency percentile value, and the evaluation value calculation part calculates a ratio between the high frequency component amount and the low frequency component amount as the evaluation value in one of the case that the correction low frequency percentile value is larger than a predetermined upper limit value and the case that the correction low frequency percentile value is smaller than a predetermined lower limit value.

7. The awakening level estimation apparatus for vehicle as in claim 6, wherein the frequency component power is leveled by multiplying the frequency component power by a value multiplied by the frequency component power by a power number n of each frequency.

8. The awakening level estimation apparatus for vehicle as in claim 7, wherein the evaluation value calculation part calculates a high frequency component amount based on frequency component powers excluding a maximum value among the respective frequency component powers calculated by the frequency component amount calculation part.

9. The awakening level estimation apparatus for vehicle as in claim 8, wherein the evaluation value calculation part calculates the evaluation value with time, and the decision part decides that it is in a situation in which a driver is to be warned in the case that a value of a counter is increased or decreased in response to the evaluation value and also the value of the counter reaches a determination value.

10. The awakening level estimation apparatus for vehicle as defined in claim 1, wherein the correction factor calculation part calculates a first ratio between a predetermined normal high frequency percentile value corresponding to a high frequency percentile value of a normal driver and the calculated high frequency component percentile value and calculates a second ratio between a predetermined normal low frequency percentile value corresponding to a low frequency percentile value of a normal driver and the calculated low frequency component percentile value and calculates the correction factor based on the first ratio and the second ratio.

11. The awakening level estimation apparatus for vehicle as defined in claim 10, wherein the proportion of the normal low frequency percentile value to the normal high frequency percentile value is between 2 times and 2.5 times.

12. The awakening level estimation apparatus for vehicle as in claim 1, wherein the evaluation value calculation part calculates a ratio between the high frequency component amount and the low frequency component amount as the evaluation value in one of the case that the high frequency percentile value is larger than a predetermined upper limit value and the case that the high frequency percentile value is smaller than a predetermined lower limit value.

13. The awakening level estimation apparatus for vehicle as in claim 1, wherein the correction factor calculation part calculates a correction low frequency percentile value by multiplying the low frequency percentile value by a ratio between the normal high frequency percentile value and the high frequency percentile value, and the evaluation value calculation part calculates a ratio between the high frequency component amount and the low frequency component amount as the evaluation value in one of the case that the correction low frequency percentile value is larger than a predetermined upper limit value and the case that the correction low frequency percentile value is smaller than a predetermined lower limit value.

14. The awakening level estimation apparatus for vehicle as in claim 1, wherein the frequency component power is leveled by multiplying the frequency component power by a value multiplied by the frequency component power by a power number n of each frequency.

15. The awakening level estimation apparatus for vehicle as in claim 1, wherein the evaluation value calculation part calculates a high frequency component amount based on frequency component powers excluding a maximum value among the respective frequency component powers calculated by the frequency component amount calculation part.

16. The awakening level estimation apparatus for vehicle as in claim 1, wherein the evaluation value calculation part calculates the evaluation value with time, and the decision part decides that it is in a situation in which a driver is to be warned in the case that a value of a counter is increased or decreased in response to the evaluation value and also the value of the counter reaches a determination value.

17. An awakening level estimation method for vehicle, the method for deciding an awakening level of a driver based on an evaluation value calculated, comprising:

a first step of calculating each frequency component power by making frequency conversion of a displacement amount of a vehicle in a direction of vehicle width detected in a time series manner;

a second step of calculating an average value of the frequency component powers calculated by the signal processing part as a high frequency component amount;

a third step of calculating a maximum value of the frequency component powers within a predetermined frequency domain including a stagger frequency to become apparent in a state in which the awakening level of the driver decreases as a low frequency component amount;

a fourth step of calculating a high frequency percentile value in which the proportion of the total sum to the sum of incidences counted from the lower frequency component powers results in a predetermined proportion in a histogram of the high frequency component amount;

a fifth step of calculating a low frequency percentile value in which the proportion of the total sum to the sum of incidences counted from the lower frequency component powers results in a predetermined proportion in a histogram of the low frequency component amount;

a sixth step of calculating a correction factor based on the high frequency percentile value and the low frequency percentile value; and a seventh step of calculating an evaluation value by correcting a ratio between the high frequency component amount and the low frequency component amount by the correction factor.

18. The awakening level estimation method for vehicle as defined in claim 17, wherein the predetermined proportion is between about 70% and about 90%.

19. The awakening level estimation method for vehicle as defined in claim 18, wherein the sixth step includes a step of calculating a first ratio between a predetermined normal high frequency percentile value corresponding to a high frequency percentile value of a normal driver and the calculated high frequency component percentile value, a step of calculating a second ratio between a predetermined normal low frequency percentile value corresponding to a low frequency percentile value of a normal driver and the calculated low frequency component percentile value, and a step of calculating the correction factor based on the first ratio and the second ratio.

20. The awakening level estimation method for vehicle as defined in claim 19, wherein the proportion of the normal low frequency percentile value to the normal high frequency percentile value is between 2 times and 2.5 times.

21. The awakening level estimation method for vehicle as in claim 20, wherein in the seventh step, a ratio between the high frequency component amount and the low frequency component amount is calculated as the evaluation value in one of the case that the high frequency percentile value is larger than a predetermined upper limit value and the case that the high frequency percentile value is smaller than a predetermined lower limit value.

22. The awakening level estimation method for vehicle as in claim 21, wherein in the sixth step, a correction low frequency percentile value is calculated by multiplying the low frequency percentile value by a ratio between the normal high frequency percentile value and the high frequency percentile value and in the seventh step, a ratio between the high frequency component amount and the low frequency component amount is calculated as the evaluation value in one of the case that the correction low frequency percentile value is larger than a predetermined upper limit value and the case that the correction low frequency percentile value is smaller than a predetermined lower limit value.

23. The awakening level estimation method for vehicle as defined in claim 17, wherein the sixth step includes a step of calculating a first ratio between a predetermined normal high frequency percentile value corresponding to a high frequency percentile value of a normal driver and the calculated high frequency component percentile value, a step of calculating a second ratio between a predetermined normal low frequency percentile value corresponding to a low frequency percentile value of a normal driver and the calculated low frequency component percentile value, and a step of calculating the correction factor based on the first ratio and the second ratio.

24. The awakening level estimation method for vehicle as defined in claim 23, wherein the proportion of the normal low frequency percentile value to the normal high frequency percentile value is between 2 times and 2.5 times.

25. The awakening level estimation method for vehicle as in claim 17, wherein in the seventh step, a ratio between the high frequency component amount and the low frequency component amount is calculated as the evaluation value in one of the case that the high frequency percentile value is larger than a predetermined upper limit value and the case that the high frequency percentile value is smaller than a predetermined lower limit value.

26. The awakening level estimation method for vehicle as in claim 17, wherein in the sixth step, a correction low frequency percentile value is calculated by multiplying the low frequency percentile value by a ratio between the normal high frequency percentile value and the high frequency percentile value and in the seventh step, a ratio between the high frequency component amount and the low frequency component amount is calculated as the evaluation value in one of the case that the correction low frequency percentile value is larger than a predetermined upper limit value and the case that the correction low frequency percentile value is smaller than a predetermined lower limit value.

* * * * *